United States Patent [19]

Kohner et al.

[11] 4,383,689

[45] May 17, 1983

[54] SYMBOL GAME METHOD

[75] Inventors: Michael Kohner, Parsippany; Frank Kohner, Englewood; Albert Stubbmann, Franklin Lakes, all of N.J.

[73] Assignee: Michael Kohner Corporation, Parsippany, N.J.

[21] Appl. No.: 272,098

[22] Filed: Jun. 10, 1981

[51] Int. Cl.[3] ..... A63F 9/04

[52] U.S. Cl. ..... 273/145 R; 273/1 G; 273/146; 273/272

[58] Field of Search ..... 273/145 A, 145 B, 145 C, 273/145 CA, 145 D, 145 E, 144 R, 144 A, 144 B, 272, 1 R, 1 GE; 368/3, 93

[56] References Cited

U.S. PATENT DOCUMENTS

| | | | |
|---|---|---|---|
| D. 209,531 | 12/1967 | Koch | 368/93 X |
| 857,878 | 6/1907 | Haynes | 273/145 CA |
| 2,200,456 | 5/1940 | Shultz | 273/145 CA |
| 2,724,595 | 11/1955 | Amann | 273/145 A |
| 2,823,036 | 2/1958 | Worth | 273/1 |
| 3,204,956 | 9/1965 | Ames | 273/145 R X |
| 3,606,336 | 9/1971 | Krause | 273/272 |
| 3,724,847 | 4/1973 | Compton | 273/145 C X |

FOREIGN PATENT DOCUMENTS

| | | | |
|---|---|---|---|
| 123964 | 10/1901 | Fed. Rep. of Germany | 273/145 A |
| 15224 | of 1884 | United Kingdom | 368/93 |

OTHER PUBLICATIONS

Boggle® ©1973, Parker Brothers Trademark for its Hidden Word Game Equipment.

Scrabble® Playthings, Jan. 1956, p. 4.

*Primary Examiner*—Richard C. Pinkham

*Assistant Examiner*—Arnold W. Kramer

*Attorney, Agent, or Firm*—Kirschstein, Kirschstein, Ottinger & Cobrin

[57] ABSTRACT

A game whose object is the formation of words or groupings of symbols utilizing a plurality of multi-faceted playing pieces, such as cubes, each of whose faces bears a single symbol such as a letter. The playing pieces are positioned in a receptacle which is mounted for spring-loaded pivotal movement on a support structure. The receptacle is engaged in cocked position by a latching mechanism attached to the support, and when the latching mechanism is disengaged, the receptacle is rapidly rotated about a horizontal axis, causing the receptacle to forcefully strike an abutment mounted on the support, thus scrambling the pieces. The receptacle then is restored to the cocked position in which the playing pieces are so supported that a single upper symbol is displayed on each piece. A first player utilizes the displayed symbols to form a primary intelligible grouping of symbols, such as a word, and that player, as well as the other players, must then form additional words or groupings of symbols utilizing the symbols in the primary grouping. The formation of the primary word by the first player and the subsequent words by all of the players must be completed within separate predetermined time periods measured by hourglass-type timers.

4 Claims, 8 Drawing Figures

FIG. 2
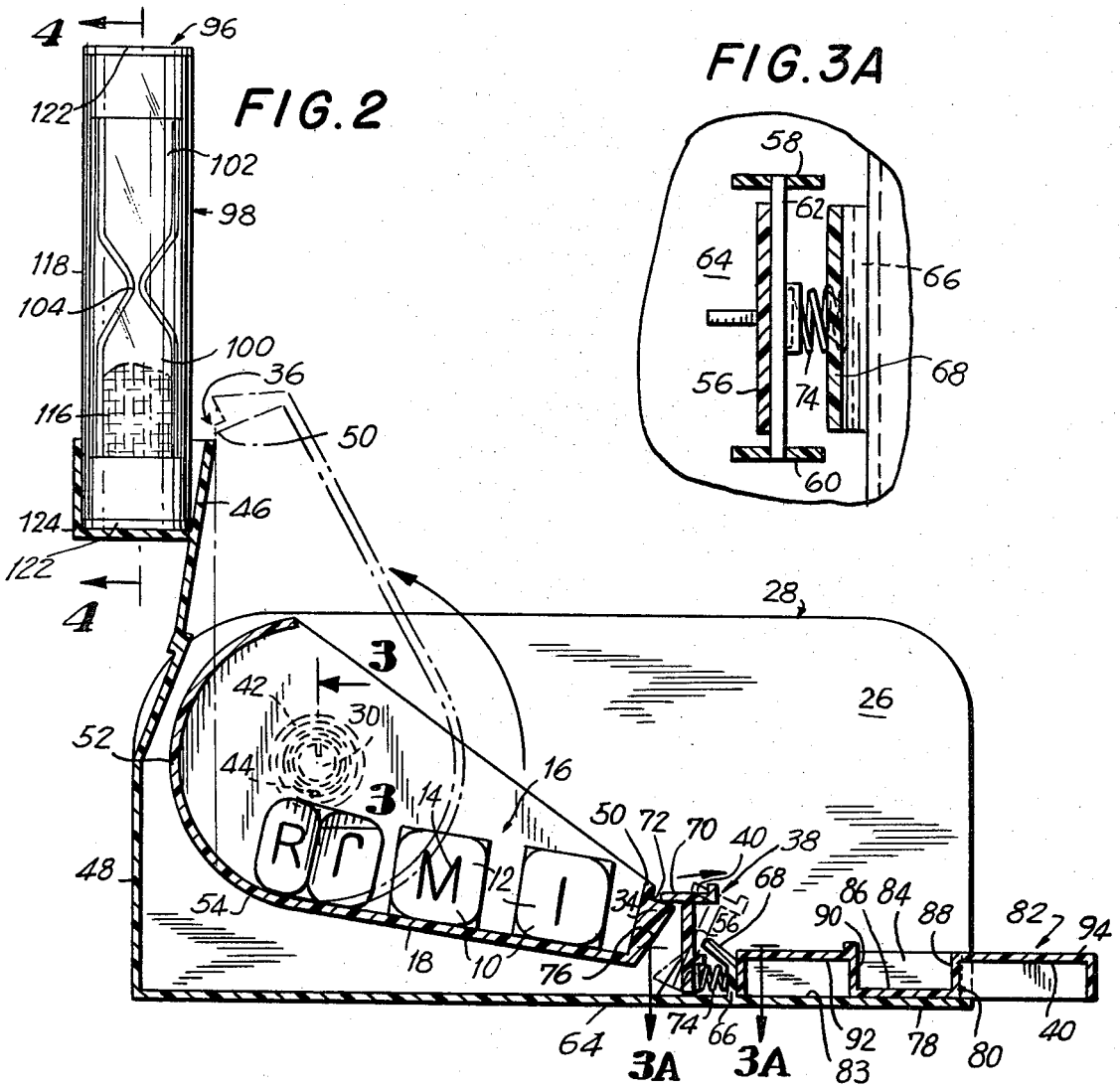
FIG. 3A
FIG. 3
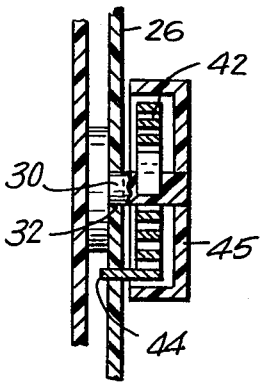
FIG. 4
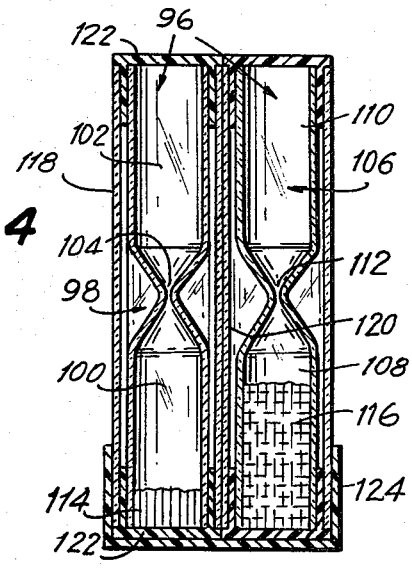

SYMBOL GAME METHOD

BACKGROUND OF THE INVENTION

1. Field of the Invention

The present invention relates generally to games and, more particularly, to word or symbol games utilizing multi-faceted playing pieces, such as cubes or dice, bearing single letters or symbols on each of their faces.

2. Description of the Prior Art

Word games whose object is the formation of words utilizing a limited group of letters selected substantially at random are well-known in the prior art. Similarly, there are a number of prior art games wherein playing pieces in the nature of tiles or cubes are utilized having letters or symbols on some or all of their flat faces, and said pieces then are physically arranged and juxtaposed so that words or other intelligible groupings of symbols are formed with the letters or symbols appearing on the uppermost faces of the pieces.

A significant drawback with the prior art word or symbol games of this type is that no built-in actuating means is provided to scramble or mix the playing pieces so that a substantially random array of letters or symbols can be obtained for selection by the players and subsequent formation into words or other groupings. The prior art games generally require that the playing pieces be placed into a cup and manually agitated to achieve scrambling or, alternatively, that no scrambling be done at all, but the playing pieces are obscured in some manner from the view of the player and the player randomly selects the pieces without being able to see the symbols thereon. These randomization techniques currently prevalent are time-consuming and inefficient, and generally detract from the excitement and pace of the game.

Another drawback of the prior art games of this type is that they generally do not have built-in anti-cheating devices for use during play, such as means for obstructing the vision of other players so that they cannot see the letters or symbols which are being utilized by the player who is to form words or other groupings until such word formation has been completed. In games where players are given a limited amount of time to form their words, or in which advance knowledge of the letters or symbols being utilized by another player provides an advantage, the lack of any anti-cheating means can enable players to gain unfair advantage over their fellow players and to undermine the rules of the game.

SUMMARY OF THE INVENTION

1. Objects of the Invention

It is the object of the present invention to provide an enjoyable word or symbol game for use by persons of all ages that overcomes the aforementioned drawbacks of the prior art.

Another object of the present invention is to provide a game with built-in actuating means for scrambling or randomization of the playing pieces.

A further object of the present invention is to provide anti-cheating means to prevent players from prematurely ascertaining the letters or symbols which are being utilized by another player to form words or other groupings.

An additional object of the present invention is to provide a game wherein words or groupings of symbols must be formed by the players within a predetermined period of time, measured by timing means provided with the game.

Still another object of the present invention is to provide a unique scrambling device which can be simply activated by the touch of a finger and which effectively scrambles or randomizes symbol-bearing elements that are placed therein.

Still a further object of the invention is to provide a compact game support structure which has a scrambling device attached thereto and which has means for mounting thereon a timing device and a tray for containing the symbol-bearing elements after they have been scrambled.

2. Features of the Invention

In keeping with these objects and others which will become apparent hereinafter, one feature of the invention resides, briefly stated, in a compact word game which comprises a plurality of multi-faceted playing pieces, such as cubes or dice, at least some of which faces bear at least one visually discernible symbol such as a letter or a number. Said pieces are of such configuration that they tend to rest on a surface with one face or facet in a generally upward position. A playing piece receptacle having a flat receiving section whereon the playing pieces may be positioned so that each piece has a flat face in an upward position is pivotally mounted on a game support structure having a base, a rear wall, and opposed side walls attached to said base. The receptacle is pivotally mounted on the side walls for movement about a horizontal axis by means of trunnions extending outwardly from the receptacle and supported by bearings in each of the side walls, which side walls extend above the receptacle.

In accordance with the invention, a scrambling mechanism is provided for the game. The scrambling mechanism includes a built-in actuator such as a torsion spring which has one end attached to the game support and the other end attached to one of the trunnions extending from the receptacle and supported by the bearing in the game housing. The receptacle has a forward edge with a latching flange extending outwardly therefrom which is engaged by a latching mechanism mounted on the game support to detain the receptacle in cocked position with its flat section approximately horizontal. When the latch is disengaged from the flange on the forward edge of the receptacle, the spring snaps the receptacle rapidly and pivotally with respect to a horizontal axis.

An abutment wall is mounted on the support in the path of pivotal movement of the receptacle so that when the latch is disengaged and the receptacle is moved about the horizontal axis by the torsion spring, a striker portion of the receptacle will forcibly collide with the abutment wall. This collision causes an abrupt cessation in the rotary motion of the receptacle and of the playing pieces contained therein so that the playing pieces are hurled against the abutment wall and land back in a trough of the receptacle and are thereby scrambled. The receptacle is then returned to the open cocked position by manually moving the forward edge of the receptacle downward and causing the latching flange to be engaged by the latching mechanism. Some or all of the pieces, as a consequence of the scrambling, will now have a symbol-bearing face in an upward position on the substantially horizontal flat section to which they shift from this trough, which face is different from the symbol-bearing face that was initially in an upward position.

The game of the present invention is played by cocking the receptacle and then having a first player place all the playing pieces on the flat section of the receptacle with each piece having one symbol-bearing face in an upward position. The player then disengages the latching mechanism, thereby enabling the torsion spring to snap the receptacle pivotally and causing the receptacle to strike against the abutment wall, thus effecting the scrambling of the pieces in the trough as previously described. The player then returns the receptacle to the open cocked position wherein the latching flange on the receptacle's forward edge is engaged by the latching mechanism and activates a timing device such as an hourglass-type sand timer to measure a first predetermined time period. Within that first time period, the player must form a primary word or grouping of symbols consisting of a predetermined number of letters or symbols, utilizing only the symbols that are in upward positions on the faces of the pieces that have been scrambled, the pieces at that time being on the horizontal flat section.

After the formation of the primary word or grouping of symbols by the first player, the first player and all other players must form additional words or groupings of symbols, such as by recording said words with pen and paper, utilizing only the letters or symbols which formed the primary word or grouping. A second predetermined time period, greater than the first time period, is measured from the completion of the primary word by the first player, utilizing timing means such as a second sand timer having a longer period of sand fall than the timer used to measure the first period. The formation of words or groupings by the players terminates with the end of the second time period and point values are assigned to each word or grouping formed by each player based on the number of letters in the words and/or other criteria. The player with the highest number of points is the winner of the game or round.

In accordance with the above features of the invention, the side and rear walls of the game support on which the playing receptacle is pivotally mounted are high enough to obstruct the lateral visual observation of the other players when the first player is selecting the symbol-bearing pieces he will utilize in forming the primary word or groupings of symbols. This prevents the other players from cheating or gaining unfair time advantage by being able to prematurely see the letters being selected by the first player and to begin considering the formation of words from the letters before the commencement of the second time period.

In accordance with yet another feature of the invention, the timing means utilized to measure the first and second time periods consists of two simple small hourglass-type timers individually encased in transparent cyclindrical tubes which are adjoined so that their longitudinal axes are substantially parallel. One of the timers has a greater amount of sand in it or a more constricted throat than the other timer. A bracket is provided on the back of the rear wall of the game support on which the timers can be detachably mounted. At the commencement of the game, the timing device is mounted in the bracket. To begin measuring the first time period, which commences when the scrambling has been completed by the first player and the receptacle has been returned to the open cocked position, the timer is inverted so that the sand begins to flow into the lower chambers of each hourglass. When the sand is the faster hourglass has completely flowed into the lower chamber, the first time period has terminated. When the sand in the slower hourglass has completely flowed into the lower chamber of that hourglass, the second time period has terminated.

The novel features which are considered as characteristic of the invention are set forth in particular in the appended claims. The invention itself, however, both as to its construction and its methods of operation, together with additional objects and advantages thereof, will be best understood from the following description of specific embodiments when read in connection with the accompanying drawings.

BRIEF DESCRIPTION OF THE DRAWINGS

FIG. 2 is a sectional view taken substantially along line 2—2 of FIG. 1.

FIG. 3 is a fragmentary sectional view taken substantially along line 3—3 of FIG. 2.

FIG. 3A is an enlarged fragmentary sectional view taken substantially along line 3A—3A of FIG. 2 and showing the lower portion of the latching mechanism.

FIG. 4 is a sectional view taken substantially along line 4—4 of FIG. 3.

DETAILED DESCRIPTION OF THE PREFERRED EMBODIMENTS

Figure 1:
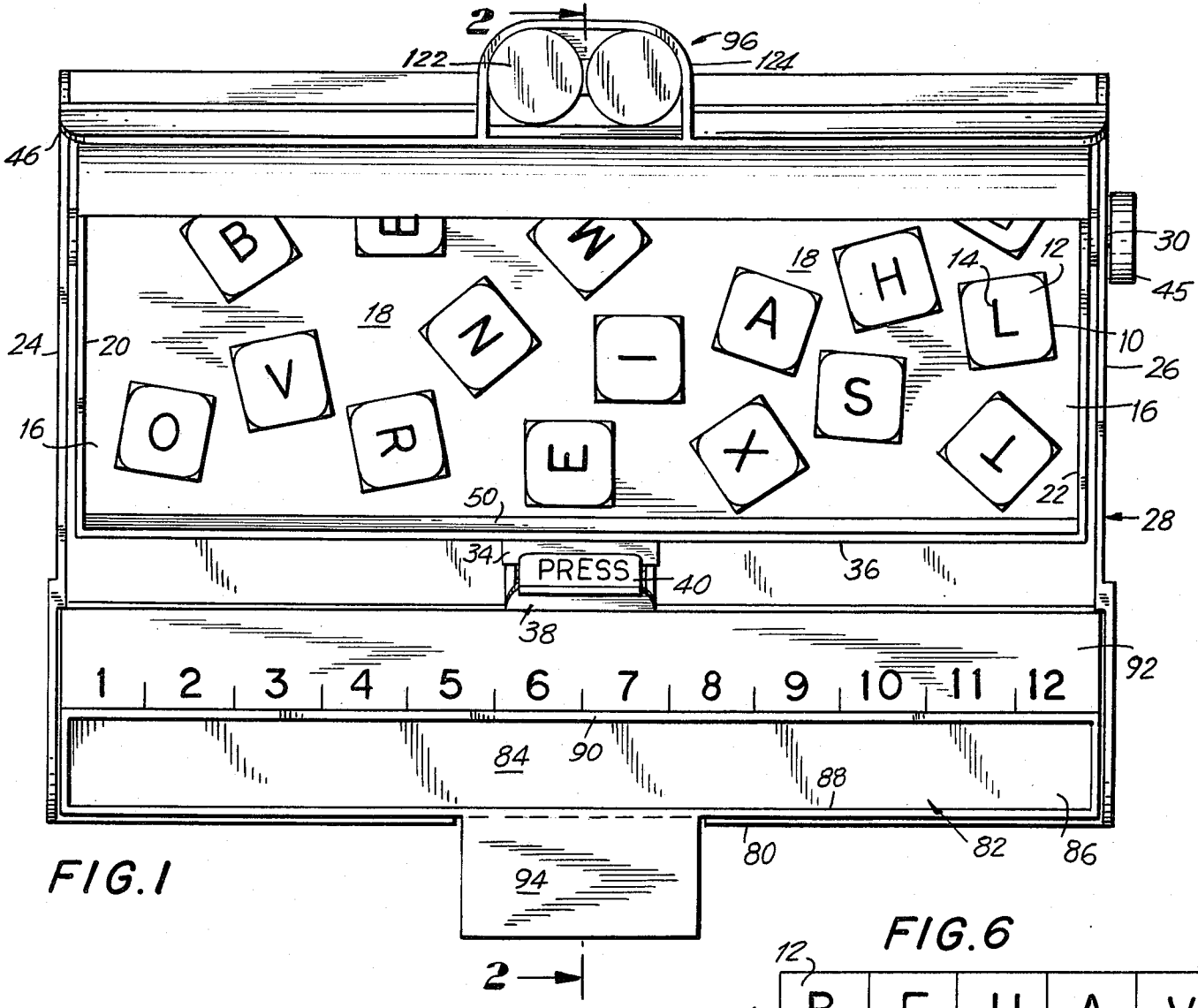
FIG. 1 is a top plan view of a game in accordance with the present invention showing the playing pieces positioned in the playing piece receptacle and the receptacle in open cocked position.

Referring now to the drawings, and particularly to FIG. 1 thereof, the present game is played utilizing a plurality of playing pieces 10, preferably of cubic configuration, such as dice. Each playing piece has several flat or substantially flat faces 12, six in the case of cubic pieces, some or all of which faces bear thereon a symbol such as a letter 14. The playing pieces 10 are placed into a receptacle 16 and are positioned on the receiving section 18 thereof, constituting a substantially flat face that is horizontal when the receptacle is cocked in the open position shown in FIG. 1 and in full lines in FIG. 2. The playing piece receptacle 16 has opposed side walls 20 and 22 which are respectively pivotally mounted for rotation about a horizontal axis on side walls 24 and 26 of a game support 28 by means of, for example, registered horizontal trunnions 30 of which one, shown in FIG. 3, is supported by the side walls 20 and 22 of the receptacle in a bearing 32.

The receptacle 16 is retained in the open cocked position by engagement of a detent 34 of the receptacle 16, constituting, for example, a flange or lip protruding from forward edge 36 of the receptacle, with a latching mechanism 38. A finger pad 40 bearing the word "PRESS" is provided which, when manually depressed, disengages the detent 34 from the latching mechanism 38.

A built-in actuating (energy-storing) mechanism such as a spiral torsion spring 42 shown in FIGS. 2 and 3 has one end attached to one of the trunnions 30 and its other end attached to a pin 44 affixed to the adjacent side wall 26 of the game support, said torsion spring 42 being coiled about the trunnion 30. A squat cylinder 45, shown in cross-section in FIG. 3, is affixed to the end of the trunnion 30 which extends beyond the side wall 26, and is positioned so as to conceal the spring 42 from view and serve as a cocking handle.

When finger pad 40 is depressed to disengage the detent 34 from the latching mechanism 38, the spring 42 snaps the trunnion 30, and hence the receptacle 16, about a horizontal axis. An abutment structure, such as a substantially vertical wall 46, extends upwardly from the rear wall 48 of the game support, shown in FIG. 2, into the path of movement of the game receptacle 16, which path of movement is indicated by the curved arrow in FIG. 2. The forward edge 36 of the receptacle 16 has a striker portion 50 on its upper surface and when the receptacle 16 is rotated rapidly around the horizontal axis by the spring 42, the striker portion 50 forcibly collides with the abutment wall 46, as shown in phantom lines in FIG. 2, and the receptacle is then in closed position. The shock of that collision and the abrupt cessation of the rapid motion of the receptacle 16 causes the playing pieces 10 contained therein to be hurled against the abutment wall 46, after which they fall onto the curved rear edge 54 of the flat section 18. The shock of the collision causes further jumbling of the orientation of the playing pieces 10.

The receptacle 16 thereafter is returned from the closed position to the open or cocked position by manual downward movement of the detent 34 until it engages the latching mechanism 38 and the playing pieces fall from the trough into position on the flat section 18 (now substantially horizontal) with many of the playing pieces having a different flat face 12 bearing a different symbol 14 in upward position than was the case before the scrambling of the pieces was effected.

The latching mechanism 38 is shown in greater detail in FIGS. 2 and 3A and comprises a vertical support member 56 mounted in two U-shaped bearings 58 and 60 by means of an axle pin 62 fastened to the lower portion of vertical member 56 and journalled for horizontal rotation in bearings 58 and 60. The bearings 58 and 60 are securely mounted on the base 64 of the game support 28. A vertical flange 66 extends from and is substantially perpendicular to base 64 of the game support on the side of the vertical support member 56 that faces away from the receptacle 16. Centered on that flange 66 is an inclined stop 68 sloping upwardly from the flange 66 and inclined generally toward the vertical support member 56. Finger pad 40 is attached and substantially perpendicular to the top of the vertical support member 56 and has a latching flange 70 offset from the vertical member 56 on the side thereof which faces the receptacle 16.

The detent 34 of the receptacle 16 has an upper surface 72 which, when the receptacle is in the open latched position, is horizontal and is detachably engaged by the latching flange 70 to hold the receptacle in cocked horizontal position. When it is desired to release the detent 34 so as to permit pivotal scrambling movement of the receptacle, finger pad 40 is depressed, causing vertical support member 56 to swing away from the receptacle until it abuts against the inclined stop 68 as shown in phantom lines in FIG. 2, and disengaging the latching flange 70 from the surface 72 of the detent 34. Biasing restoring means such as a helical compression spring 74 is situated between the lower portion of vertical support member 56 and the vertical flange 66 and, when the manual pressure is removed from finger pad 40, the spring 74 urges the vertical member 56 back to its original vertical position.

The detent 34 has a flat inclined cam surface 76 extending downwardly from its upper horizontal surface 72 and defining an angle of less than 90 degrees with said upper surface. When the receptacle is manually swung to the open cocked position, the cam surface 76 slideably contacts latching flange 70 and urges finger pad 40 and vertical support member 56 towards stop 68 until the cam surface clears the front edge of the flange 70, whereupon the spring 74 rapidly returns the vertical member 56 to its vertical position in which the flange 70 rides back over the horizontal surface 72 of the detent 34.

As shown in FIG. 2, the side walls 24 and 26 of the game support 28 extend above the receptacle 16 which is mounted thereon. Furthermore, the rear wall 48 of the game support and the abutment wall 46 mounted thereon, extend well above receptacle 16 at the rear of the support. These wall portions of the support 28 effectively serve as anti-cheating devices by obstructing the vision of the players other than the player who is attempting to form the primary word so as to prevent said other players from seeing the symbols on the uppermost faces of the playing pieces in the receptacle before the time period for those players to begin formation of words or groupings has commenced.

As shown in FIG. 2, the base 64 of the game support has a flat horizontal front portion 78 in one piece therewith which extends forwardly from the vertical flange 66 and terminates with a second vertical flange 80. A playing piece tray 82, shown in FIGS. 1 and 2, is removably mounted in the well defined by vertical flange 66, front base portion 78, vertical flange 80, and side walls 26 and 28. The playing piece tray comprises a playing piece track 84 having a floor 86, a front wall 88, an opposed rear wall 90, a calibrated horizontal ledge 92 attached and generally perpendicular to the top of rear wall 90, and a tab-like handle 94 attached and substantially perpendicular to front wall 88 and extending forwardly from said front wall generally away from the rear wall 90. The tray 82 is positioned on the front portion 78 of the support base 64 so that the calibrated ledge 92 abuts against flange 66 and so that the front wall 88 of the rack 84 abuts against the flange 80, with the handle 94 extending forwardly over a niche at the top of flange 80.

After the scrambling of the playing pieces 10 has been completed by the first player, he selects and removes at least a predetermined number of the playing pieces from the receiving section 18 of the receptacle 16 that he requires to spell out a word he has settled upon and places them on the track 84 of the playing piece tray 82. The playing piece tray 82 may then be removed from the game support 28. The tray 82 may then be placed on a table or other surface so that the first player may conveniently arrange the playing pieces contained on the track 84 of the tray into a primary word he has settled upon.

In accordance with the preferred embodiments of the invention, timing means 96 shown in FIGS. 2 and 4 comprises a first hourglass timer 98 having symmetrical opposed chambers 100 and 102 connected by a narrow throat 104 and a second hourglass shaped timer 106 having opposed symmetrical chambers 108 and 110 connected by a narrow throat 112. A quantity of particulate material 114, such as sand, is contained in chamber 100 of timing means 98 and a greater quantity of sand 116 is contained in chamber 108 of timer 106. The timers 98 and 106 are respectively encased in transparent tubes 118 and 120 having cylindrical caps 122 on their upper and lower ends respectively. Tube 118 and tube 120 are adjoined, such as by adhesion, so that their longitudinal axes are substantially parallel and so that the tubes 118 and 120 and the timers 98 and 106 encased therein form a unit.

As illustrated in FIGS. 1 and 2, the timing device 96 hereinabove described is removably mounted on a bracket 124 which is attached to the abutment wall 46 on the side of said wall which faces away from playing piece receptacle 16. When the scrambling of the playing pieces has been completed by the first player, and the receptacle 16 has been returned to the open cocked position, the timing device 96 is removed from the bracket 124, inverted and returned to the bracket 124 or placed on a flat surface, thus causing sand 114 and 116 to flow from chambers 100 and 108 respectively through narrow throats 104 and 112 into chambers 102 and 110. The first period of time is measured from the inversion of timing device 96 until the smaller quantity of sand 114 contained in timer 98 has completely flowed into chamber 102, and the second time period is measured from the completion of the flow of sand 114 until the completion of the flow of the larger quantity of sand 116 contained in timer 106 from chamber 108 to chamber 110.

Figure 5A:
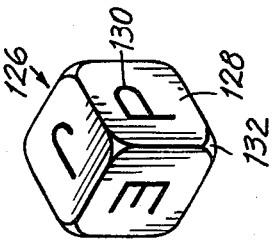
FIG. 5A is a perspective view of a typical playing piece showing some of the letters on each of the flat faces thereof.

In FIG. 5A, a typical playing piece 126 having a generally cubic configuration and six flat faces 128 is shown. On each of the flat faces 128 of the piece 126, there appears a different symbol 130 which in FIG. 5A is a letter. The playing piece 126 shown in FIG. 5A has rounded corners 132 for greater ease of rotational movement during the scrambling process.

Figure 5B:
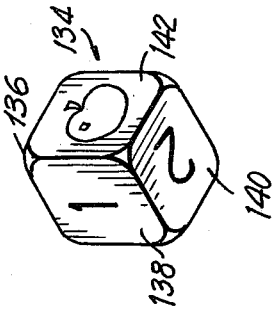
FIG. 5B is a perspective view of a typical playing piece showing some of the numbers or symbols on each of the flat faces thereof.

In FIG. 5B, a playing piece 134 is shown, also having a generally cubic configuration and rounded corners 136. The playing piece 134 has on its flat faces symbols other than letters. For example, faces 138 and 140 bear numbers and face 142 bears a pictorial representation of an apple. Pieces bearing numbers on their faces could be adapted to a mathamatical or code-type game, and pieces bearing pictorial symbols on their faces could be adapted to a game for young children who do not yet recognize letters or are not capable of forming words.

Figure 6:
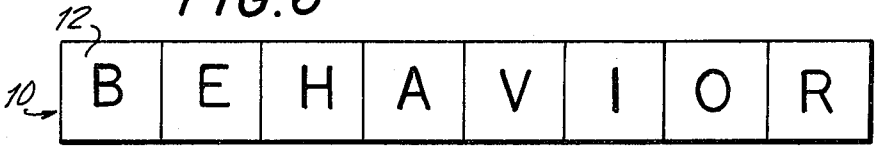
FIG. 6 is an illustration of a primary word formed from a selected number of the playing pieces shown in the receptacle in FIG. 1.

FIG. 6 shows the eight-letter word "BEHAVIOR" which is an example of a primary word which can be formed utilizing the letters appearing on the upward faces 12 of the playing pieces 10 that appear in the receptacle 16 in FIG. 1.

A typical set of rules ascribes different point values to the primary word according to its length, e.g.: eight or nine letters—plus 10 points; 10 or 11 letters—plus 20 points; 12 or more letters—plus 30 points; failure to build a primary word—minus 10 points, and different point values to subsequent words according to their length, e.g.: each two-, three-, and four-letter word—plus one point; each five-letter word—plus two points; and each longer word—plus three points. The players take turns for the primary word.

It will be understood that each of the elements described above, or two or more together, may also find a useful application in other types of constructions differing from the types described above.

While the invention has been illustrated and described as a word or symbol game utilizing a unique scrambling device, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims:

1. A method of playing a game for the selection and juxtaposition of optically discernible symbols to form intelligible groupings comprising a plurality of playing pieces, each having at least two flat faces, at least some of which faces bear at least one optically discernible symbol, the pieces being adapted for resting on a flat, substantially horizontal surface in a position such that one flat symbol-bearing face is in a generally upward-facing position, a game support, a playing-piece receptacle rotatably mounted on said support and having a substantially flat receiving section whereon said playing pieces may be positioned when the receptacle is in a first extreme position so that each piece has an initial face in the upward position, said receptacle being rotatable to a second extreme position, and actuating means operatively attached to said support for scrambling said playing pieces after they have been positioned on the receiving section of the receptacle so that at least some of the pieces have a face in an upward position that is different from said initial face, said actuating means being cocked by movement of said receptacle to said first extreme position and scrambling said pieces as it snaps the receptacle to said second extreme position, said method comprising the steps of:

(a) a first player selecting a plurality of the playing pieces, placing said playing pieces into the playing piece receptacle, said receptacle being in the first extreme position, and positioning said pieces on the receiving section of said receptacle so that each of said pieces has an initial face in the upward position;

(b) said first player utilizing the actuating means to scramble said playing pieces so that at least some of said pieces have a face in the upward position that is different from said initial face;

(c) said first player, within a first predetermined period of time from the completion of the scrambling of the playing pieces effected by utilization of said actuating means, selecting a predetermined number of pieces and juxtaposing them so that at least one intelligible grouping of the symbols appearing on the faces of the pieces in the upward position is formed;

(d) said first player and one or more other players, within a second predetermined period of time from the formation of said intelligible groupings of symbols by said first player, forming additional intelligible groupings of symbols utilizing exclusively some or all of the symbols which comprise the intelligible groupings of symbols formed by said first player; and (e) assigning values to the intelligible groupings of symbols formed by said first player and by said other players respectively whereby it may be determined which player has accumulated the highest total value.

2. A method according to claim 1 wherein said first predetermined time period is less than said second predetermined time period.

3. A method according to claim 1 wherein said predetermined number of playing pieces to be selected by the first player for juxtaposition and formation into an intelligible grouping of the symbols appearing on the upward faces of said pieces is eight, and wherein said first player must form one intelligible grouping including all of said eight symbols.

4. A method according to claim 1 wherein said optically-discernible symbols are letters of an alphabet and said intelligible groupings of symbols are words.

* * * * *